US007784647B2

(12) United States Patent
Tourigny

(10) Patent No.: US 7,784,647 B2
(45) Date of Patent: Aug. 31, 2010

(54) ACTUATORS FOR FLUID-DISPENSER CONTAINERS AND CONTAINERS INCLUDING SUCH ACTUATORS

(75) Inventor: Jay S. Tourigny, Collinsville, CT (US)

(73) Assignee: Zynon Technologies, LLC, New Britain, CT (US)

( * ) Notice: Subject to any disclaimer, the term of this patent is extended or adjusted under 35 U.S.C. 154(b) by 309 days.

(21) Appl. No.: 11/767,795

(22) Filed: Jun. 25, 2007

(65) Prior Publication Data

US 2007/0295754 A1 Dec. 27, 2007

Related U.S. Application Data

(63) Continuation-in-part of application No. 11/502,026, filed on Aug. 10, 2006.

(60) Provisional application No. 60/708,436, filed on Aug. 16, 2005.

(51) Int. Cl.
*B65D 83/14* (2006.01)
*B05B 11/00* (2006.01)

(52) U.S. Cl. ..... 222/205; 222/321.6; 222/321.7; 222/321.9; 222/402.13; 222/543

(58) Field of Classification Search ..... 222/205, 222/207, 321.6, 402.1, 402.13, 402.25, 402.24, 222/543, 321.7, 321.9; 401/119, 125, 190; 239/106, 115, 600, 333, 337, 389
See application file for complete search history.

(56) References Cited

U.S. PATENT DOCUMENTS 3,338,479 A * 8/1967 Marraffino ..... 222/129
3,572,591 A 3/1971 Brown
3,593,894 A * 7/1971 Kehoe et al. ..... 222/402.1
3,792,802 A * 2/1974 Gores ..... 222/402.13
3,841,532 A * 10/1974 Gores ..... 222/205
3,917,127 A * 11/1975 Berenstain ..... 222/402.13
4,865,228 A * 9/1989 Landecker ..... 222/153.13
5,335,832 A * 8/1994 de Laforcade ..... 222/402.13
5,415,327 A * 5/1995 Favre ..... 222/321.8
5,743,468 A * 4/1998 Laidler ..... 239/600
5,772,079 A 6/1998 Gueret
6,053,368 A * 4/2000 Geimer ..... 222/321.6
6,305,863 B1 10/2001 Gueret
6,309,124 B1 10/2001 Gueret
6,622,890 B2 * 9/2003 Gueret ..... 222/321.7
6,736,562 B2 5/2004 Whitmore (Continued)

*Primary Examiner*—Kenneth Bomberg
(74) *Attorney, Agent, or Firm*—Cantor Colburn LLP

(57) ABSTRACT

An actuator (10, 10', 110) for a fluid-dispenser container, e.g., an aerosol container (14) or a non-aerosol pump container (114), has in one version (actuators 10 and 10') a base (18) having a port (20) which receives fluid from the container (14) and dispenses the fluid via a shallow cavity (24, 24'). In another version of the actuator, the actuator (110) has a base (44) and a cover (46) which may be positioned either in a closed or open position relative to each other. In the closed position, fluid is transported through an extended conduit of actuator (110) provided by a base conduit (58) which is connected in fluid flow communication with a cover conduit (70) to discharge fluid through a cover orifice (66). When cover (46) is in the open position, fluid is dispensed via base conduit (58) through a shallow cavity (54) in the same manner as that of actuators (10, 10').

16 Claims, 7 Drawing Sheets

U.S. PATENT DOCUMENTS 6,866,437 B2 3/2005 Gueret
2005/0257805 A1 11/2005 Williams
2008/0169312 A1* 7/2008 Kee ..... 222/205

* cited by examiner

ACTUATORS FOR FLUID-DISPENSER CONTAINERS AND CONTAINERS INCLUDING SUCH ACTUATORS

CROSS-REFERENCE TO RELATED APPLICATIONS

This application is a continuation-in-part of application Ser. No. 11/502,026 filed on Aug. 10, 2006 in the name of Jay Scott Tourigny and entitled "Device For Applying A Substance Disposed Within A Liquid Container To An Applicator", which claims the benefit of U.S. Provisional Patent Application No. 60/708,436, filed on Aug. 16, 2005.

BACKGROUND OF THE INVENTION

1. Field of the Invention

This invention relates to actuators for dispenser containers, typically hand-sized containers, which are used for storing and dispensing fluids, and to dispenser containers having such actuators.

2. Description of Related Art

A standard aerosol container is typically a small metal container that contains a product to be dispensed, and a propellant to force the product through a valve and out of the container. Both the propellant and the product are kept inside the container by a valve assembly which is mounted on the container. The product is dispensed through an actuator (e.g., a button, spout or spray dome) that is mounted on the valve assembly and dispenses the contents as a stream or mist, usually in a direction sideways or at a slight angle to the longitudinal axis of the container when the container is seated on a horizontal surface in its normal upright position. Aerosol valve assemblies and actuators are available in a wide variety of configurations from a diverse variety of vendors.

Because the aerosol container is hermetically sealed when it is filled and pressurized, it offers an excellent means of storing, transporting and ultimately dispensing its contents without the risk of evaporation, spilling or spoilage. Aerosols are packaged in a controlled environment, so the product chemical formula typically remains consistent from container to container and production run to production run. Aerosol containers are not refillable, so it is impossible to contaminate or tamper with the container's contents, assuring product purity. Finally, aerosols are labeled when packaged so the contents are easy to identify and have appropriate use and warning statements.

The above-described physical attributes make aerosols a favored device for technicians and service people to use and dispense high purity fluids needed to clean, lubricate and/or otherwise service high technology items including (but not limited to) computers, electronic assemblies, optics, fiber optics, bearings, medical devices, etc.

Dispenser containers are also available as non-aerosol containers which do not contain a propellant and instead dispense the stored fluid by the user manually operating a pump in order to dispense the stored fluid through a valve surmounting the pump. A standard pump container is typically a small metal or plastic container that contains a product to be dispensed. Unlike an aerosol container, a pump-dispenser container is closed by a pump valve which is spring-loaded or otherwise constructed to permit the user to impose a repeated pumping action which dispenses the product from the container as a spray or mist. Pump-dispenser containers eliminate the need for a propellant and have the advantages that the cost of adding propellant to the container is avoided, as are environmental problems associated with certain propellants. Further, each stroke of a pump valve dispenses a precise, predetermined amount of fluid. This enables metered dose dispensing of fluids by giving the operator control of the amounts of fluid dispensed. In addition, the pump-dispenser container need not be made strong enough to resist the pressure of a propellant. A further significant advantage of a pump-dispenser container is that being unpressurized, it may be allowed (depending on the nature of the liquid it contains) to be legally transported as a non-hazardous and non-regulated material. In contrast, all aerosol containers are subject to regulations for transport because they are pressurized. On the other hand, pump-dispenser containers require on-going manual pumping and the fact that pump-dispenser containers usually may be refilled if desired carries the disadvantage that they lack the integrity of sealed aerosol containers. Such pump-dispenser containers are available in a wide variety of configurations from a number of different vendors.

SUMMARY OF THE INVENTION

Generally, the present invention provides an actuator which is mounted on the fluid-dispensing valve of an aerosol or pump-dispenser container in order to facilitate control of the direction of discharge of the stored fluid, e.g., a liquid. Aerosol containers typically dispense a propellant plus a liquid in the form of fine globules, i.e., an aerosol. Pump-dispenser containers typically dispense a liquid, although they may also be used to dispense gels, greases, creams, foams and the like. In one aspect of the invention, the actuator has a base defining a deck side in which is formed a shallow cavity. A base conduit extends through the base and terminates in a deck orifice through which the stored fluid is dispensed into or through the cavity. Another aspect of the invention generally provides that the actuator optionally has a cover within which is formed a cover conduit terminating in a cover orifice, the cover being movable between a closed position and an open position. In the closed position, the cover overlies the deck side and connects the base conduit in fluid flow communication with the cover conduit to provide an extended conduit through which the stored fluid is discharged. When in the open position the cover is out of the way and unimpeded discharge of fluid from the cover orifice occurs in the same manner as the actuator embodiment which does not have a cover. In some aspects of the invention, the valve of the container has a stem and is operated by depressing the stem. In other aspects, the valve has a stem cavity, and the actuator includes a stem disposed on its port side and sized to be received within the stem cavity, and a shallow cavity disposed on its deck side. Examples of sealed containers with which the actuator of the present invention may be used include aerosol containers and non-pressurized pump-type liquid-dispensing containers.

Specifically, in accordance with one aspect of the present invention, there is provided an actuator for a fluid-dispenser container, the container having a dispensing valve which is manipulatable to dispense stored fluid from the container. The actuator comprises the following components. A base which has a port side in which there is a valve port and an opposite, deck side which has a cavity in which there is a deck orifice, the deck orifice being connected in fluid flow communication with the valve port to define a base conduit. The valve port is configured to be connected to the dispensing valve in fluid flow communication therewith, so that manipulation of the actuator to operate the dispensing valve dispenses stored fluid through the base conduit and out the deck orifice into the shallow cavity.

Another aspect of the present invention provides that the deck side of the actuator is configured for manipulating by a user's finger or fingers while leaving the deck side sufficiently exposed during such manipulating that fluid dispensed from the actuator is accessible to the user during such manipulating.

In accordance with another aspect of the present invention, the actuator further comprises a cover having an interior side and an exterior surface, the cover being movable between a closed position in which the interior side of the cover overlies the deck side of the base, and an open position in which the cover is displaced from the deck side of the base to expose the deck orifice to enable dispensing stored fluid therefrom. The cover has a cover orifice in its exterior surface and a cover port in its interior side, the cover orifice and the cover port being connected in fluid flow communication with each other to define a cover conduit. The cover port is configured to be connected in fluid flow communication with the deck orifice when the cover is in the closed position to thereby connect the cover conduit in fluid flow communication with the base conduit to define an extended conduit. In this way, manipulation of the actuator to operate the dispensing valve dispenses stored fluid from the cover orifice via the extended conduit when the cover is in the closed position.

In one aspect of the present invention, such dispensing valve is one which has a valve stem, and the valve port of the actuator is configured to receive therein such valve stem.

In another aspect of the present invention, such dispensing valve is one which has a valve seat in lieu of a valve stem, and wherein the actuator further comprises a valve stem carried on the port side of the base of the actuator and configured to be seated within such valve seat. In a related aspect of the invention, the valve stem is carried in the valve port of the actuator.

Other aspects of the present invention provide one or more of the following features, alone or in combinations of any two or more: the cover port may comprise a nipple which is configured to be inserted into the deck orifice in fluid-tight relationship therewith when the cover is in the closed position; the deck orifice may have a longitudinal axis and the cover conduit may have a first leg which is disposed coaxially with the longitudinal axis of the deck orifice when the cover is in the closed position, and a second leg which is disposed transversely of the first leg and terminates in the cover orifice; and the cover may be connected to the body by a hinge about which the cover pivots relative to the body between the closed position and the open position.

Any actuator of the present invention may be mounted on a fluid-dispensing container having stored fluid therein. In a related aspect of the invention, the deck orifice has a longitudinal axis and the dispensing valve is operated by depressing the stem in a direction parallel to the longitudinal axis of the deck orifice.

These and other objects, features, and advantages of the present invention will become apparent in light of the detailed description of the invention provided below and the accompanying drawings. The apparatus described below constitutes a preferred embodiment of the underlying invention and does not, therefore, constitute all aspects of the invention that will or may become apparent by one of skill in the art after consideration of the invention disclosed overall herein.

BRIEF DESCRIPTION OF THE DRAWINGS

FIG. 4C-1 is an exploded version of FIG. 4C;

DETAILED DESCRIPTION OF THE INVENTION AND SPECIFIC EMBODIMENTS THEREOF

Referring to FIGS. 1A, 1B and 3A-3C, an actuator 10 for a valve 12 of an aerosol container 14 (FIG. 3A) is provided. The aerosol container 14 is typically hermetically sealed and non-refillable, and the valve 12 (FIG. 3A) typically includes a stem 16. The valve 12 can be activated to disperse fluid from container 14 by depressing the stem 16. Examples of containers with which the actuator 10 can be used include aerosol containers as illustrated and non-aerosol dispensing containers having pump-type dispensing valves for dispensing fluids such as liquids, gels, greases, creams, foams and the like. A typical example of an aerosol valve is the "Standard Precision Valve" manufactured by the Precision Valve Corporation, 700 Nepperham Ave., Yonkers, N.Y., 10703. Examples of non-pressurized pump-type dispenser valves are the Emsar 32 ms-32 w/1" cup model dispenser offered by Emsar Inc. of 125 Access Road, Stratford, Conn., 06615, and the "PZ1-140" manufactured by Seaquist Perfect Company of 1160 North Silver Lake Road, Cary, Ill., 60003. Although the actuators of the present invention are below largely described in connection with use with aerosol containers, they are not limited to such use and may also be used in connection with non-aerosol, pump-type dispenser containers, as described below in connection with FIG. 6.

Figure 1A:
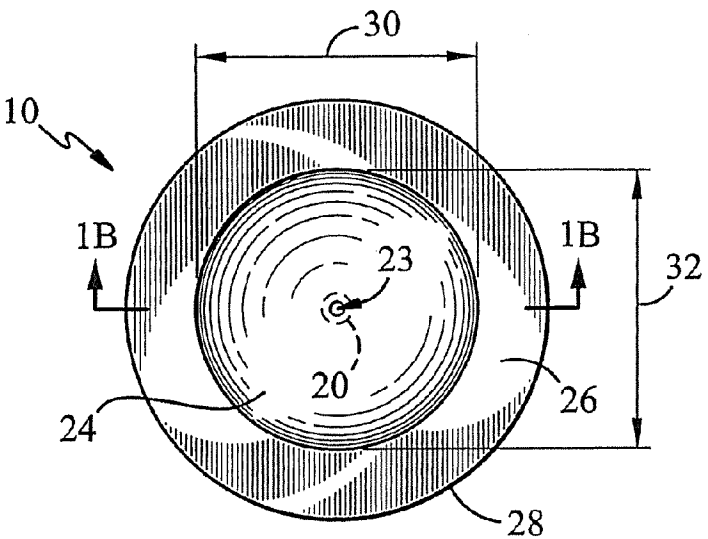
FIGS. 1A and 1B show, respectively, a top plan view and a cross-sectional side view in elevation, taken along line 1B-1B of FIG. 1A, of one embodiment of the actuator of the present invention.
Figure 1B:
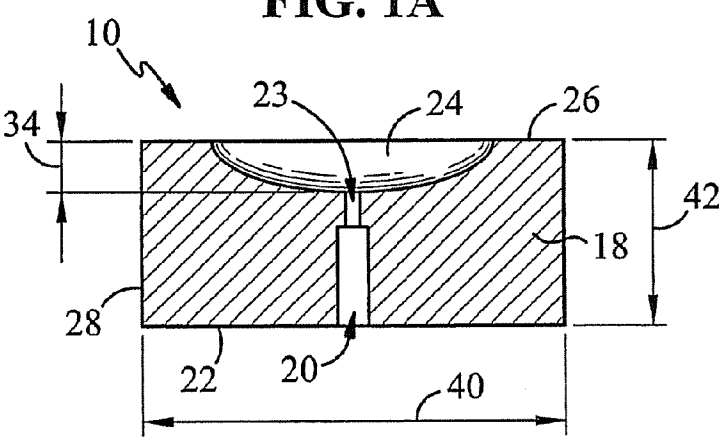

Referring to FIGS. 1A and 1B, the actuator 10, which may be made from any suitable material, e.g., metal or a synthetic polymeric material (plastic), has a base 18 with a port 20 disposed on a port side 22, a shallow cavity 24 disposed on a deck side 26, and an orifice 23 that extends between the port 20 and the shallow cavity 24. The orifice 23 provides fluid communication between the port 20 and the shallow cavity 24. A sidewall 28 extends between the oppositely disposed first and second sides 22, 26. The actuator base 18 shown in FIGS. 1A and 1B is circularly shaped. In alternative embodiments, the base 18 can be shaped otherwise; e.g., oblong, etc. The actuator 10 can be mounted as original equipment on an aerosol or pump-spray container. Alternatively, it may be provided as an independent device that is offered separately and can be fit onto conventional aerosol or pump-spray containers by a third party or the operator.

Figure 2A:
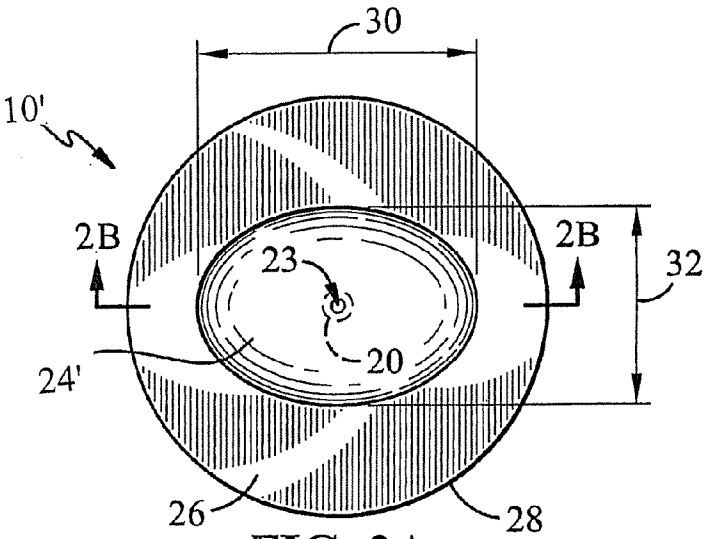
FIGS. 2A and 2B show, respectively, a top plan view and a cross-sectional side view in elevation, taken along line 2B-2B of FIG. 2A, of another embodiment of the actuator of the present invention.
Figure 2B:
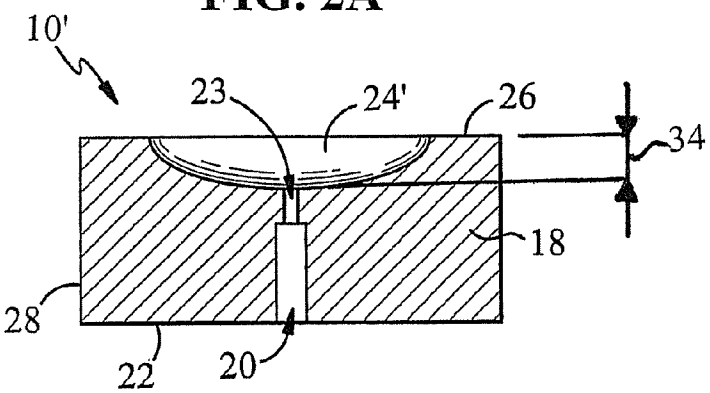

The shallow cavity 24 of actuator 10 (FIGS. 1A, 1B) and the shallow cavity 24' of actuator 10' (FIGS. 2A, 2B) each have respective lengths 30, widths 32 and depths 34. The maximum depth 34 of the shallow cavity 24 or 24' is less in magnitude than either of the length 30 or width 32, and is preferably less than one-half of the smaller of the length 30 and width 32. The shape of the shallow cavity 24 or 24' can vary to suit the application at hand. For example, for those applications wherein the operator uses an applicator (e.g., wipe, towel, pad, etc.) in contact with the distal portion of the operator's finger, the shallow cavity 24 or 24' is preferably shaped to receive the applicator and an amount of the distal portion of the operator's finger. In the example shown in FIGS. 1A and 1B, the shallow cavity 24 is a shallow half-oval in cross section (FIG. 1B) but is circular in plan view (FIG. 1A), having a length 30 and width 32 equal to one another, and a depth 34 less than the length 30 or width 32. In other embodiments (see FIGS. 2A and 2B), the shallow cavity 24' may be oval-shaped in plan view, with a length 30 greater than a width 32, and a depth 34 that is less than one-half the shorter width 32. In a preferred embodiment, the shallow cavity 24 is oval or oblong-shaped specifically in the form of a distal portion of an operator's finger; i.e., shaped as the pad portion of the fingertip. This facilitates the operator pressing a wipe or pad or other applicator into the liquid dispensed via deck orifice 23.

In all these embodiments, the shallow cavity 24 or 24' advantageously: 1) helps the operator easily dispense the contents of the aerosol container 14 onto the surface of the applicator without having to hold the aerosol container 14; 2) helps to prevent liquid from spilling out of the actuator 10 or 10' during application, and helps to prevent spillage of any residual liquid that may be present in the actuator 10 or 10'; 3) helps to locate and prevent the operator's finger from slipping off the actuator 10 or 10' during actuation of the container's valve 12; 4) facilitates distribution of the liquid throughout the applicator; and 5) facilitates distribution of liquid from the container into an applicator.

Figure 3B:
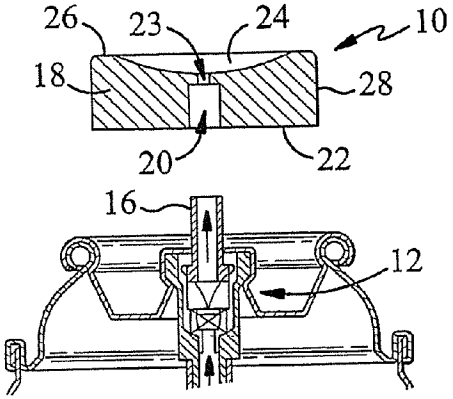
FIG. 3B is an exploded, partial cross-sectional view in elevation of the aerosol container of FIG. 3A with the actuator of FIGS. 2A and 2B separated from, and disposed above, the valve of the container.
Figure 3C:
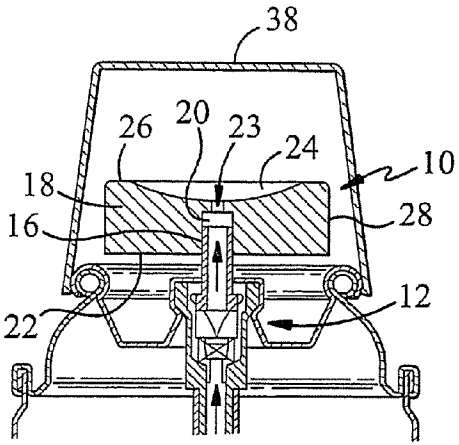
FIG. 3C is a partial cross-sectional view in elevation of the arrangement of FIG. 3A showing a protective overcap mounted on the aerosol container.
Figure 3A:
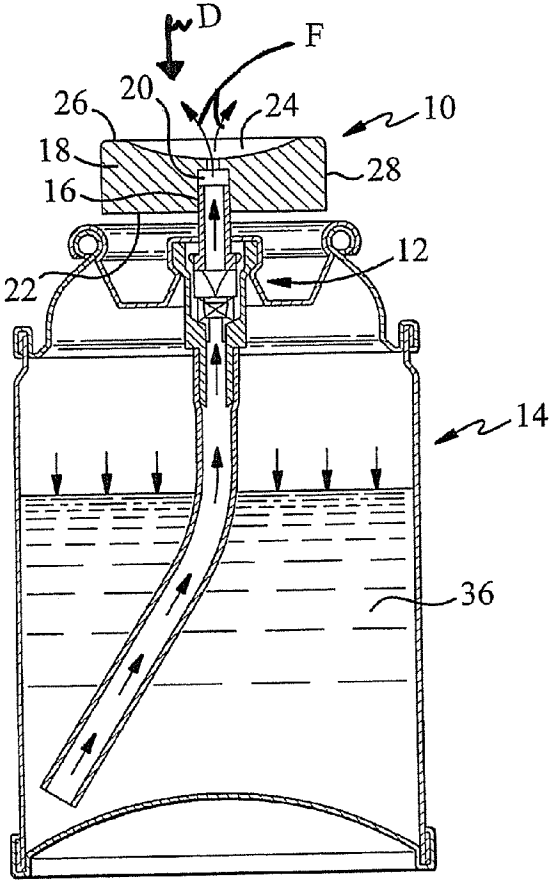
FIG. 3A is a cross-sectional view in elevation of the actuator of FIGS. 2A and 2B mounted on the valve stem of a conventional aerosol container.

The port 20 is configured and dimensioned so it is easily mounted on the stem 16 of a standard aerosol valve 12 (e.g., by press fit as shown in FIG. 3A). The orifice 23 is positioned and sized to receive liquids exiting the stem 16 of the valve 12. The actuator 10 or 10' securely fits on the valve stem 16 so the actuator 10 or 10' can be transported and stored as an integral part of the aerosol container 14 without falling off, yet can be removed if so desired. For those applications where the actuator 10 or 10' is provided to a third party or the operator for mounting on a standard aerosol container, the port 20 is configured and dimensioned to have a light press-fit with the stem 16 of the aerosol valve 12.

The actuator 10 or 10' (shown in FIGS. 1A-3C as circularly shaped) is sized to permit the standard aerosol valve 12 to be actuated when the filled aerosol container 14 is situated in an upright position on a table or other suitable location surface. As stated above, the actuator 10 or 10' enables the operator to dispense liquid product 36 from an aerosol container 14 without physically holding the container 14.

The actuator 10 or 10' is also sized so that it may fit under any standard, aerosol protective overcap 38 (FIG. 3C). The overcap 38 prevents normal operational access to the actuator 10, thereby preventing the unintended actuation of the valve 12 while in transport or storage, and keeps the actuator 10 free from contamination such as dirt and dust. For example, FIG. 1B shows that the illustrated embodiment of actuator 10 has a diameter 40 and a sidewall height 42 that enables the actuator 10 to fit within a standard sized protective overcap 38; i.e., the diameter 40 of actuator 10 is sufficiently less than the inside diameter of the protective overcap 38, and the sidewall height 42 is sufficiently less than the inside height of protective overcap 38 so that attachment of protective overcap 38 to the container 14 will not cause overcap 38 to contact or displace the actuator 10. The same applies to actuator 10'. Overcap 38 is of course removed from container 14 when it is desired to manipulate actuator 10 to discharge fluid from container 14.

In use, actuator 10, as shown in FIG. 3A, will dispense fluid from container 14 through deck orifice 23 (FIG. 1A) and shallow cavity 24 in the direction shown by the arrows F when pressure is applied downwardly to actuator 10, and thereby to stem 16, in the direction indicated by the arrow D in FIG. 3A. (The same applies to actuator 10' and, when in its open position as described below, to actuator 110, both of which—with 110 in its open position—function identically to actuator 10.) This downward pressure functions valve 12 and, as long as such downward pressure is maintained, propellant inside aerosol container 14 will continue to dispense fluid from container 14. An applicator (not shown) may be placed within shallow cavity 24 to be soaked with fluid dispensed from container 14 into shallow cavity 24 by downward pressure applied to actuator 10 through the applicator by the user's fingers. If desired, actuator 10 could be removed and stem 16 of valve 12 operated to dispense fluid directly from valve 12 or via a stem cap or the like of conventional design usually supplied with aerosol containers which do not include an actuator 10 as part of the original equipment. If an aerosol container does not include an actuator such as actuator 10 (or actuator 10'), the stem cap or the like may readily be removed and replaced by an actuator 10 or 10' or, as described below in connection with FIGS. 4A-4F, an actuator 110.

It will be noted that deck side 26 of actuators 10 (FIG. 1A) and 10' (FIG. 2A) (as well as deck side 50K of actuator 110, FIG. 4E) are configured so as to be operable by the user's finger or fingers while leaving enough of the deck side exposed so that during manipulation of the actuator 10, 10' (or 110 while in its open position) the user has access to the fluid or liquid formerly stored within the container 14. That is, no tool or accessory is necessary to manipulate the actuators of the present invention. A typical diameter, for example, actuator 10 or 10', is one inch (2.54 cm) which permits ample room for manipulation of the actuators by one or two fingertips at the periphery without impeding discharge of liquid from the deck orifice 23. If desired, an applicator pad or cloth may be held under the user's fingers so as to apply the dispensed fluid directly to the applicator during manipulation of the actuator 10 or 10'.

Figure 4A:
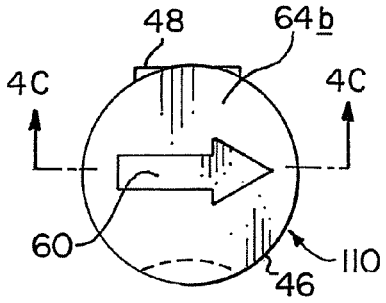
FIG. 4A is a top plan view of an actuator comprised of a base and a cover in accordance with a third embodiment of the actuator of the present invention, shown in its closed position.
Figure 4B:
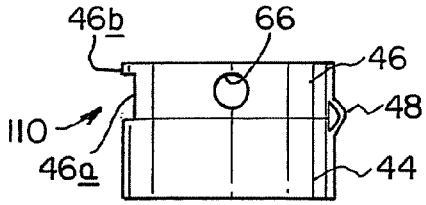
FIG. 4B is a side view in elevation of the actuator of FIG. 4A shown in its closed position.
Figure 4C:
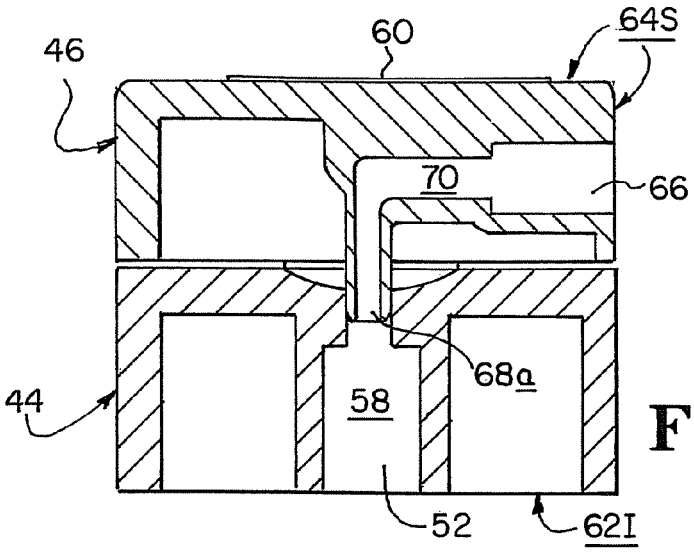
FIG. 4C is enlarged relative to FIG. 4A and is a cross-sectional view taken along line 4C-4C of FIG. 4A.
Figures 1, 4C:
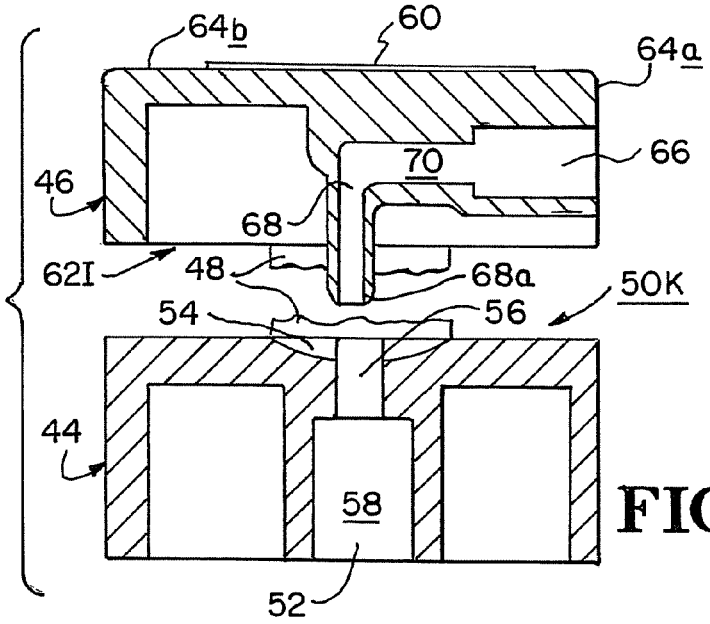
Figure 4D:
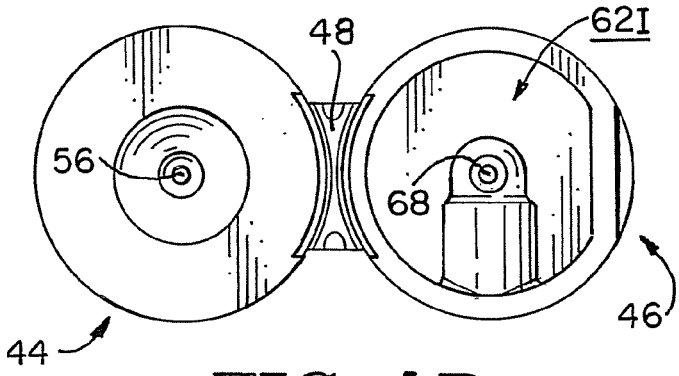
FIG. 4D is a plan view of the actuator of FIG. 4A in its open position and showing the deck side of the base and the interior side of the cover.
Figure 4E:
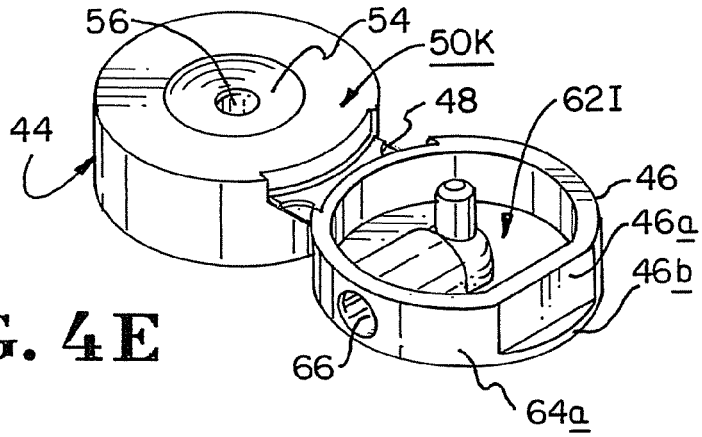
FIG. 4E is a perspective view of the actuator of FIG. 4A in its open position showing the interior side of the cover and the deck side of the base.

FIGS. 4A-4F show another embodiment of the invention comprising an actuator 110 comprised of a base 44 and a cover 46. While base 44 and cover 46 could be separate pieces, in the illustrated embodiment the base and cover are connected to each other by a hinge 48 to advantageously connect the base and cover to each other. Hinge 48 is constructed as a living hinge or otherwise so that base 44 and cover 46 are movable relative to each other between a closed position shown in FIGS. 4A, 4B and 4C and an open position shown in FIGS. 4D, 4E and 4F. As shown in FIGS. 4B and 4E, cover 46 has a flat segment 46*a* formed in a portion thereof opposite hinge 48 beyond which extends a lip 46*b*. Lip 46*b* and flat segment 46*a* cooperate to facilitate opening actuator 110, for example, by inserting the thumbnail under lip 46*b* to pivot cover 46 about hinge 48. Base 44 has a port side 50P (FIG. 4F) in which there is formed a valve port 52 (FIGS. 4C and 4F) and an opposite, deck side 50K in which there is formed a shallow cavity 54 within which a deck orifice 56 is formed (FIGS. 4D and 4E). As best seen in enlarged FIG. 4C-1, valve port 52 is connected in fluid flow communication with deck orifice 56 to define a base conduit 58. Base 44 has formed therein a shallow cavity 54 which may be the same or similar to shallow cavity 24 described above in connection with actuator 10.

Figure 4F:
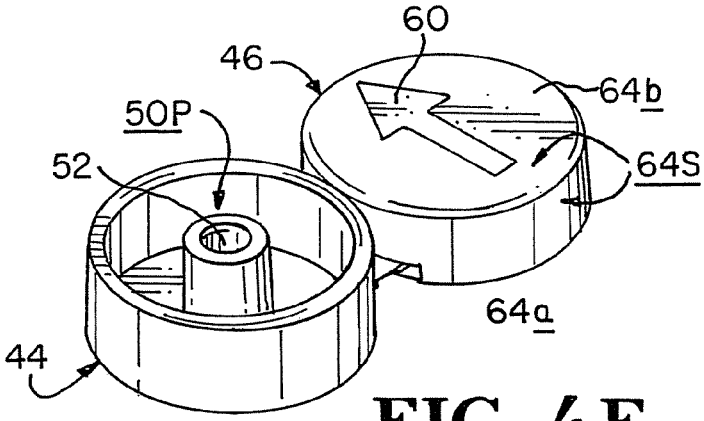
FIG. 4F is a perspective view of the actuator of FIG. 4A in its open position showing the exterior side of the cover and the port side of the base.

Cover 46 has an interior side 62I (FIGS. 4D and 4E) and an exterior surface 64S (FIG. 4F). Cover orifice 66 (FIGS. 4C-1 and 4E) is formed in the sidewall 64*a* of exterior surface 64S. Cover 46 has a cover port 68 (FIG. 4C-1) in the interior side 621 thereof, cover port 68 being in fluid flow communication with cover orifice 66 to define a cover conduit 70 (FIG. 4C-1) extending therebetween. Cover orifice 66 has its outlet in sidewall 64*a* (FIG. 4F) of exterior surface 64S of cover 46 and cover port 68 terminates in a nipple 68*a* (FIG. 4C-1). As shown in FIGS. 4A and 4F, the top surface 64*b* of exterior surface 64S of cover 46 may have embossed or otherwise applied thereto an indicia, such as arrow indicia 60 to show the operator the direction from which stored liquid or other fluid discharged from cover orifice 66 will travel.

FIG. 4C shows actuator 110 in its closed position in which nipple 68*a* is received within a narrow portion of base conduit 58 in liquid-tight engagement therewith so that the base conduit 58 and cover conduit 70 together cooperate to define an extended conduit 58, 70. As above described in connection with FIG. 4C-1, base conduit 58 comprises valve port 52 and deck orifice 56 and cover conduit 70 comprises cover port 68, including nipple 68*a* thereof, and cover orifice 66.

Figure 5B:
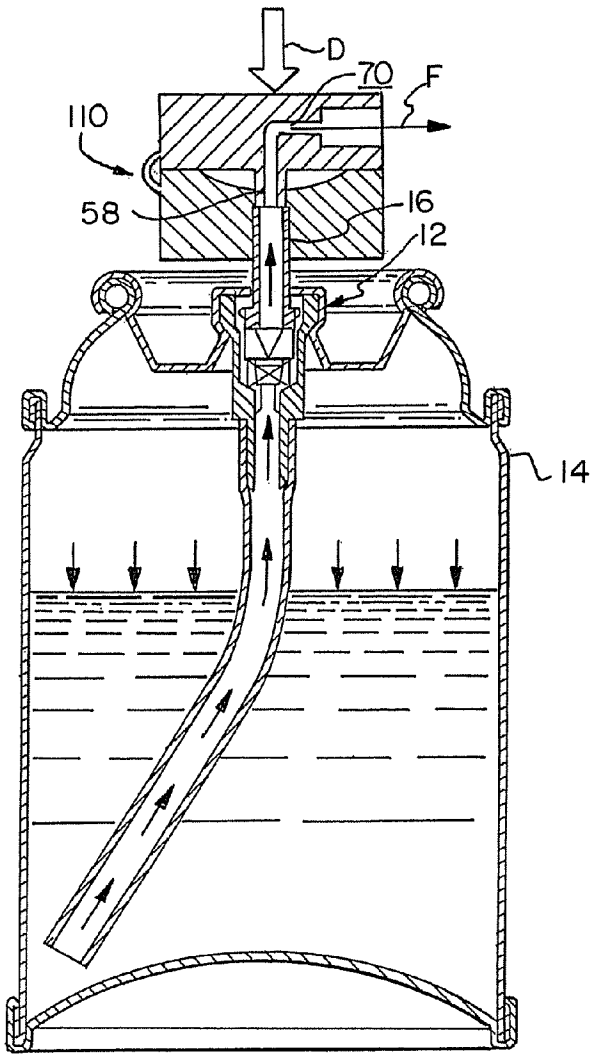
FIG. 5B is a cross-sectional partial view in elevation of the actuator of FIGS. 4A-4F shown in its closed position and mounted on the valve stem of a conventional aerosol container.
Figure 5A:
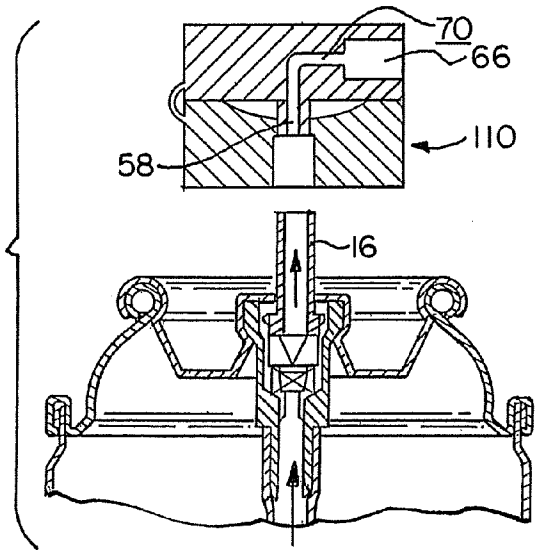
FIG. 5A is an exploded, partial cross-sectional view in elevation of an aerosol container identical to the container of FIG. 3A, with the actuator of FIGS. 4A-4F shown in its closed position and separated from and disposed above the container.

FIG. 5A shows in an exploded view actuator 110 in its closed position poised above stem 16 of valve 12 to be fitted thereon. With actuator 110 in place, as shown in FIG. 5B, by applying a force to closed-position actuator 110 in the direction shown by arrow D, valve 12 will be functioned and cause fluid to be discharged from container 14 via valve 12 through stem 16 thence into base conduit 58. As base conduit 58 is connected in fluid flow communication with cover conduit 70 to comprise extended conduit 58, 70, stored fluid flows via extended conduit 58, 70 and is discharged via cover orifice 66 in the direction shown by arrow F in FIG. 5B.

Figure 5C:
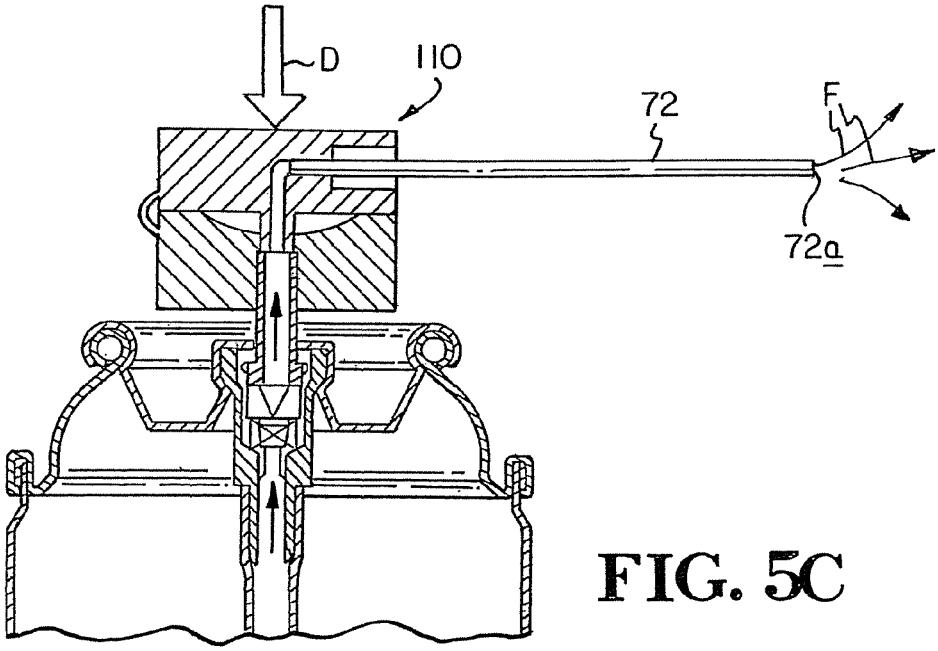
FIG. 5C is a cross-sectional partial view of the arrangement of FIG. 5B modified by the insertion of an extension tube into the cover orifice of the actuator.

As illustrated in FIG. 5C, an extension tube 72 may be inserted through cover orifice 66 into cover conduit 70 in fluid-tight communication therewith. Depression of actuator 110 by applying a force as shown by arrow D in FIG. 5C will discharge the fluid through distal end 72*a* of extension tube 72 as shown by the arrows F. In the illustrated embodiment, extension tube 72 is of a diameter so that when passed through cover orifice 66 it may be inserted in a fluid-tight fit within a suitably sized portion of cover conduit 70. FIGS. 5B and 5C show, respectively, substantially horizontal fluid discharge either directly from the actuator or via an extension tube. The use of such extension tubes is known in the art for dispensing, for example, lubricants from an aerosol container. Actuator 110 could, if desired, be configured so that cover conduit 70 extends at an angle other than perpendicular from the longitudinal axis of stem 16 to provide either an upward or downward trajectory to the discharged fluid.

Figure 5D:
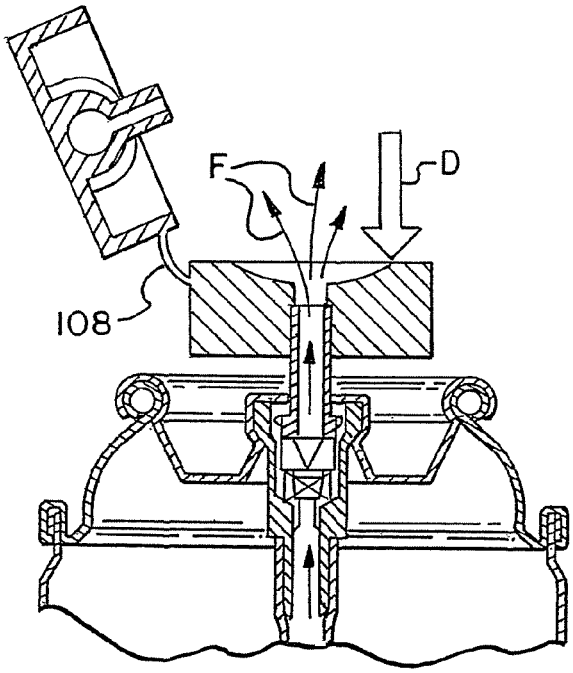
FIG. 5D is a cross-sectional partial view showing the actuator of FIGS. 4A-4F rotated ninety degrees counterclockwise from its position in FIG. 5B and shown in its open position mounted on the valve stem of a conventional aerosol container.

FIG. 5D shows actuator 110 mounted on aerosol container 14, but with cover 46 pivoted about hinge 48 to put actuator 110 into its open position. In this case, pressure applied in the direction shown by arrow D to base 44 thereof will function valve 12 to discharge stored fluid via deck orifice 56 and shallow cavity 24 as shown by the arrows F. With actuator 110 in the open position illustrated in FIG. 5D, i.e., with cover 46 displaced from deck side 50K to expose deck orifice 56 sufficiently to enable it to dispense the stored fluid without interference from cover 46. It will be seen that actuator 110 enables three different modes of dispensing fluid from container 14, as illustrated in, respectively, FIGS. 5B, 5C and 5D.

With the actuator 110 in the closed position in which cover 46 overlies deck side 50K and cover port 68 is firmly inserted into deck orifice 56 to provide a fluid-tight connection, actuator 110 may be functioned in a manner identical to that of actuator 10 of FIG. 3A.

Figure 6:
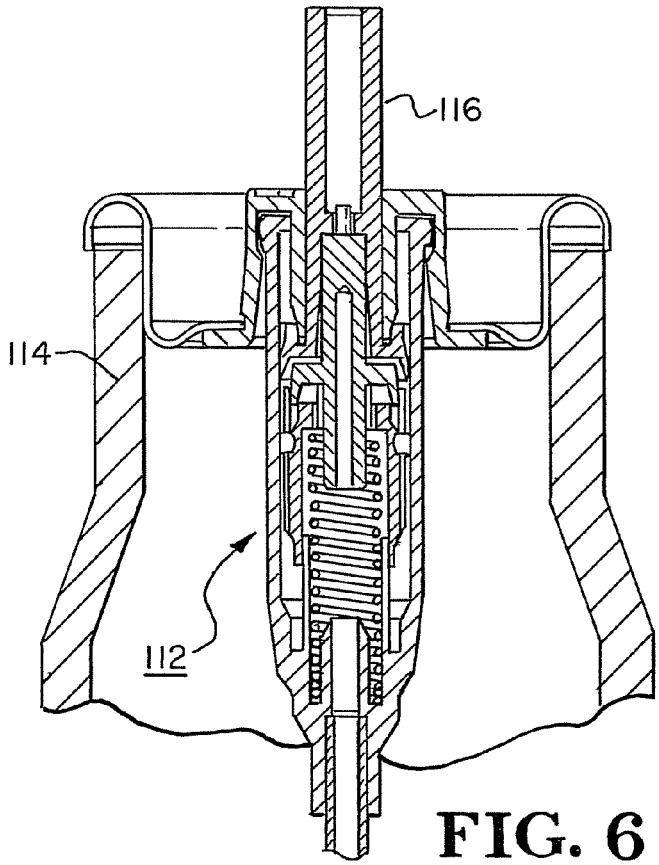
FIG. 6 is a cross-sectional view showing a conventional pump valve with the container to which it would be affixed partially shown in phantom outline.

FIG. 6 shows a valve 112 designed for a pump-spray applicator having a stem 116. A container 114 to which valve 112 would be affixed is shown in partial cross section. The actuators of the present invention may be used not only with aerosol containers but with a liquid container 114 having a non-pressurized pump-type dispensing valve 112. Such valves typically have a stem 116 that is linearly translatable along an axis, and the valve 112 is operable by pumping the stem 116 along the axis. Actuator 10 (FIG. 1A) may be mounted on stem 116 in the identical manner to which it is mounted on stem 16 as illustrated in FIG. 3A. Actuator 110 may also be mounted upon stem 116 in the manner shown in FIG. 5C or 5D, i.e., in either the open or closed position. Whereas in the case of aerosol containers such as aerosol containers 14, it is necessary only to hold down the actuator 10 or 110 to emit a steady stream of stored fluid therefrom; in the case of a pump-spray valve as illustrated in FIG. 6, repeated downward motions in the direction of arrow D must be applied to the actuator 10 or 110 in order to keep pumping fluid from container 114.

Figure 7:
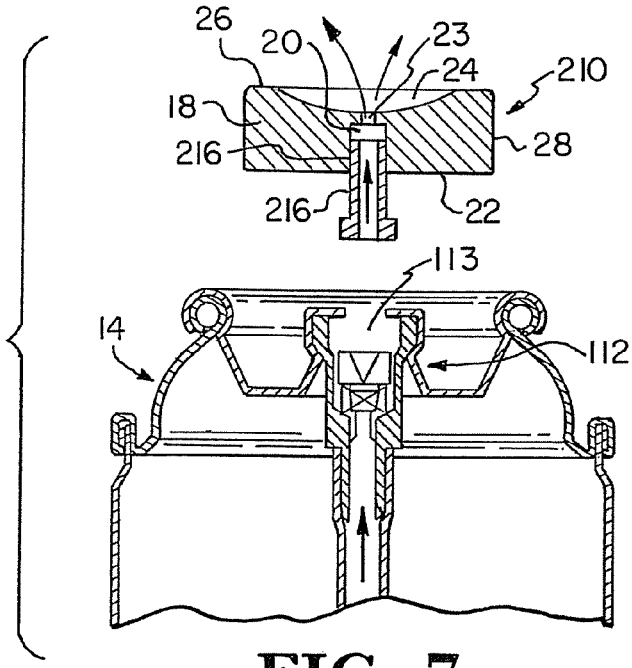
FIG. 7 is an exploded, partial cross-sectional view in elevation of a stem-containing actuator in accordance with another embodiment of the present invention, separated from and dispensed above the valve of the container.

Although the valves 12 described above have stems 16, in alternate embodiments the valves 12 may have stem seats, i.e., a cavity or space configured to receive a stem, in place of a stem. In these embodiments, the actuator 10 may include a stem disposed on the bottom side of the base 18 of actuator 10 or the base 44 of actuator 110, which stem is sized to fit within the stem cavity of the valve 12. This type of actuator is illustrated in FIG. 7 wherein actuator 210 is seen to be substantially the same as actuator 10 of FIGS. 1A and 1B except that the stem 216 is mounted within port 20 and protrudes outwardly (downwardly as viewed in FIG. 7) of port side 22 of actuator 210. The other parts of actuator 210 are identical to those of actuator 10 of FIGS. 1A and 1B and are identically numbered thereto. Thus, a shallow cavity 24 is formed in the deck side of actuator 210 and through which deck orifice 23 extends. The other components of actuator 210, except for actuator stem 216 are identical to those described in detail in connection with the embodiment of FIG. 3A. The other components are identically numbered to those of FIG. 3A and are not further described. Container 14 includes a valve 112 which contains a valve seat 113 dimensioned and configured to receive actuator valve 216 therein. When so assembled, the embodiment of FIG. 7 operates in the same manner as the embodiment of FIG. 3A.

While the invention has been described in detail with respect to specific embodiments thereof, it will be appreciated that the invention may take forms other than those comprising the illustrated and described specific embodiments.

What is claimed is:

1. An actuator for a fluid-dispenser container having a dispensing valve which is manipulatable to dispense stored fluid from such container, the actuator comprising:

(a) a base having a port side and an opposite, deck side, a cavity formed in the deck side and connected in fluid flow communication via a base conduit to the port side, the base conduit being configured to be connected to such dispensing valve in fluid flow communication therewith, whereby manipulating the actuator to operate such dispensing valve dispenses stored fluid through the base conduit;

(b) a cover having a cover conduit which is dimensioned and configured to be connected to the base conduit by a nipple to effectuate fluid-tight connection of the cover conduit to the base conduit, the cover further having an interior side and an exterior surface, the cover being movable between (i) a closed position in which the interior side of the cover overlies the deck side of the base and connects the cover conduit in fluid flow communication to the base conduit, and (ii) an open position in which (I) the cover conduit is disconnected from the base conduit and isolated from fluid flow through the base conduit and into the cavity, and (II) the cover is displaced from the deck side of the base to expose the deck cavity and such fluid contained therein sufficiently to enable an operator to have access to such stored fluid in the cavity, the cavity being configured to retain liquid therein;

(c) the cover conduit further comprising a cover orifice which opens to the exterior of the actuator and wherein, when the cover is in the closed position, (i) the nipple of the cover conduit is inserted into the base conduit to connect the cover conduit in fluid flow communication with the base conduit to thereby define an extended conduit comprised of the base conduit and the cover conduit connected to each other in a fluid-tight manner which prevents such fluid from flowing from the extended conduit into the cavity, and (ii) manipulating the actuator to operate the dispensing valve dispenses such stored fluid via the extended conduit from the cover orifice to exteriorly of the actuator.

2. The actuator of claim 1 wherein the deck side of the actuator is configured for manipulating by a user's finger or fingers while leaving the deck side sufficiently exposed during such manipulating that fluid dispensed from the actuator into the cavity is accessible to the user during such manipulating.

3. The actuator of claim 1 wherein when the cover is in the closed position the extended conduit passes through the cavity.

4. The actuator of claim 1, claim 2 or claim 3 wherein such dispensing valve is one which has a valve stem and wherein the base conduit of the actuator is configured to receive therein such valve stem.

5. The actuator of claim 1, claim 2 or claim 3 wherein such dispensing valve is one which has a valve seat in lieu of a valve stem, and wherein the actuator further comprises a valve stem carried on the port side of the base and configured to be seated within such valve seat.

6. The actuator of claim 5 wherein the base conduit terminates at the port side of the actuator in a valve port which is configured to receive such valve stem therein.

7. The actuator of claim 1 wherein the cover conduit further comprises a cover port which opens to the interior side of the cover, and wherein the cover port is configured to be connected in fluid flow communication with the base conduit when the cover is in the closed position.

8. The actuator of claim 1 wherein the base conduit has a longitudinal axis and, when the cover is in the closed position, the cover conduit has a first leg which is disposed coaxially with the longitudinal axis of the base conduit, and a second leg which is disposed transversely of the first leg and terminates in the cover orifice.

9. The actuator of claim 3, claim 1 or claim 7 wherein the cover is connected to the base by a hinge about which the cover pivots relative to the body between the closed position and the open position.

10. The actuator of claim 1, claim 2 or claim 3 further comprising the fluid-dispenser container and dispensing valve, the actuator being mounted on the fluid-dispenser container having stored fluid therein, the dispensing valve being manipulatable to dispense stored fluid from the container.

11. The actuator of claim 10 wherein the base conduit has a longitudinal axis and the dispensing valve comprises a valve stem, the dispensing valve being operated by depressing the valve stem in a direction parallel to the longitudinal axis of the base conduit.

12. The actuator of claim 1, claim 2 or claim 3 wherein the cavity has a length, a width and a depth, the length equals the width, and the depth is less than one-half the length.

13. The actuator of claim 1, claim 2 or claim 3 wherein the cavity has a length, a width and a depth, the length is greater than the width, and the depth is less than one-half the width.

14. The actuator of claim 10 wherein the fluid-dispenser container is an aerosol container, the dispensing valve of which comprises a stem valve, and the actuator is mounted on the container for dispensing fluid therefrom by opening such valve by manipulating the actuator.

15. The actuator of claim 1, claim 2 or claim 3 further comprising the fluid-dispenser container and dispensing valve, wherein the actuator is mounted on the fluid-dispenser container, the container being a pump-dispenser container having stored fluid therein, the dispensing valve is a pump-type dispensing valve which is operable by a pumpable stem for dispensing of fluid by repeated pumping of the stem by manipulating the actuator.

16. The actuator of claim 1 wherein the cover conduit terminates in the nipple, the nipple being dimensioned and configured to be inserted into the base conduit.

* * * * *